United States Patent [19]

Forterre et al.

[11] 4,280,111

[45] Jul. 21, 1981

[54] WAVEGUIDE CIRCULATOR HAVING COOLING MEANS

[75] Inventors: Gérard Forterre; Jacques Berthe, both of Paris, France

[73] Assignee: Thomson-CSF, Paris, France

[21] Appl. No.: 101,504

[22] Filed: Dec. 10, 1979

[30] Foreign Application Priority Data

Dec. 8, 1978 [FR] France ..... 78 34622

[51] Int. Cl.[3] ..... H01P 1/39; H01P 1/30

[52] U.S. Cl. ..... 333/1.1; 333/229

[58] Field of Search ..... 333/1.1, 24.2

[56] References Cited

U.S. PATENT DOCUMENTS

| | | | |
|---|---|---|---|
| 3,231,835 | 1/1966 | Nielsen et al. | 333/1.1 |
| 3,324,418 | 6/1967 | Caswell | 333/1.1 |
| 3,466,571 | 9/1969 | Jansen et al. | 333/1.1 |
| 3,662,291 | 5/1972 | Cotter | 333/1.1 |

*Primary Examiner*—Paul L. Gensler

*Attorney, Agent, or Firm*—Oblon, Fisher, Spivak, McClelland & Maier

[57] ABSTRACT

The invention relates to a structure for a wave-guide power circulator.

It consists of a cavity in which emerge the three guides and into which soft iron pole pieces penetrate in contact with their end inside the cavity with gyromagnetic chips and with their wall outside the cavity with a cooling device.

The invention applies to all power circulators in the ultra-high frequency band.

6 Claims, 7 Drawing Figures

WAVEGUIDE CIRCULATOR HAVING COOLING MEANS

BACKGROUND OF THE INVENTION

The present invention relates to three-gate Y power circulators for ultra-high frequencies.

Such circulators are constructed from sections of wave-guides associated together so that the whole presents a plane of symmetry parallel to two parallel planes containing either the large sides of all the wave-guide sections (common plane H), or the small sides (common plane E). The volume common to the three guides forms a resonating cavity. Non-reciprocity is provided by placing in this cavity a certain volume of gyromagnetic material subjected to a magnetizing field. Compensating, at least partially, the mismatching of impedances due to the gyromagnetic material is known. The U.S. Pat. No. 3,136,962 filed on Apr. 4, 1960 shows a circulator having n paths according to these two arrangements and indicates that the gyromagnetic material is in the form of two chips made from a gyromagnetic material lying on the conducting wall of the cavity, the matching being provided by a dielectric cylinder placed on one of the gyromagnetic chips. This structure, symmetrical, particularly interesting in the case of circulators having more than three gates, is also used in the structures having three paths.

Furthermore, it is known from U.S. Pat. No. 3,491,313 filed on Nov. 29, 1967 that the wall of the cavity may be pierced to introduce therein the pole pieces of the magnet used to bias the gyromagnetic material so as to reduce the reluctance of the magnetizing circuit on the gyromagnetic chips. Matching is provided by a prismatic metal member.

It is also known that the decoupling between the gates of a circulator decreases when the power of the incident wave exceeds a threshold which depends on the frequency of the wave and on the way in which the circulator is constructed.

SUMMARY OF THE INVENTION

The aim of the present invention is a circulator structure for ultra-high frequency waves, having an insertion loss and decoupling which remain constant up to several hundred watts.

The invention consists of a three-gate power circulator on a Y wave-guide whose magnetic biassing circuit comprises soft iron pole pieces passing through the walls of the junction cavity of said wave-guides on which lie chips of gyromagnetic material, the improvement consisting in said pole pieces each passing, furthermore, through a metal matching block integral with the wall of the cavity, having a section between that of the gyromagnetic chips and that of said block and being associated with a cooling device. The cooling device may be formed from good heat-conducting metal fins, brazed to shoulders of the pole pieces provided for this purpose, and the fins situated outside the junction cavity are cooled by natural convection or by any other exchange means.

As a variant, the cooling device is formed from two metal blades cooled by fluid circulation.

The use of pole pieces having a section between that of the matching member and that of the gyromagnetic chip ensures homogeneity of the magnetizing field, particularly by suppression of the "edge effect", particularly advantageous for it allows the volume of gyromagnetic material used to be reduced, reducing the losses due to the resulting temperature rise which is the principal cause of deterioration of the characteristics of the high-level circulators of the prior art.

The invention presents the following advantages:

the thickness of the metal matching blocks is independent of the position of the pole pieces;

the size of the section of the pole pieces in the guide is an additional matching factor as well as the ratio between the section of the pole pieces and that of the chips.

The above and other objects, features and advantages of the present invention will become apparent from the following description, given solely by way of a non-limiting illustration, taken in conjunction with the accompanying drawings.

DESCRIPTION OF THE PREFERRRED EMBODIMENT

Figure 1:
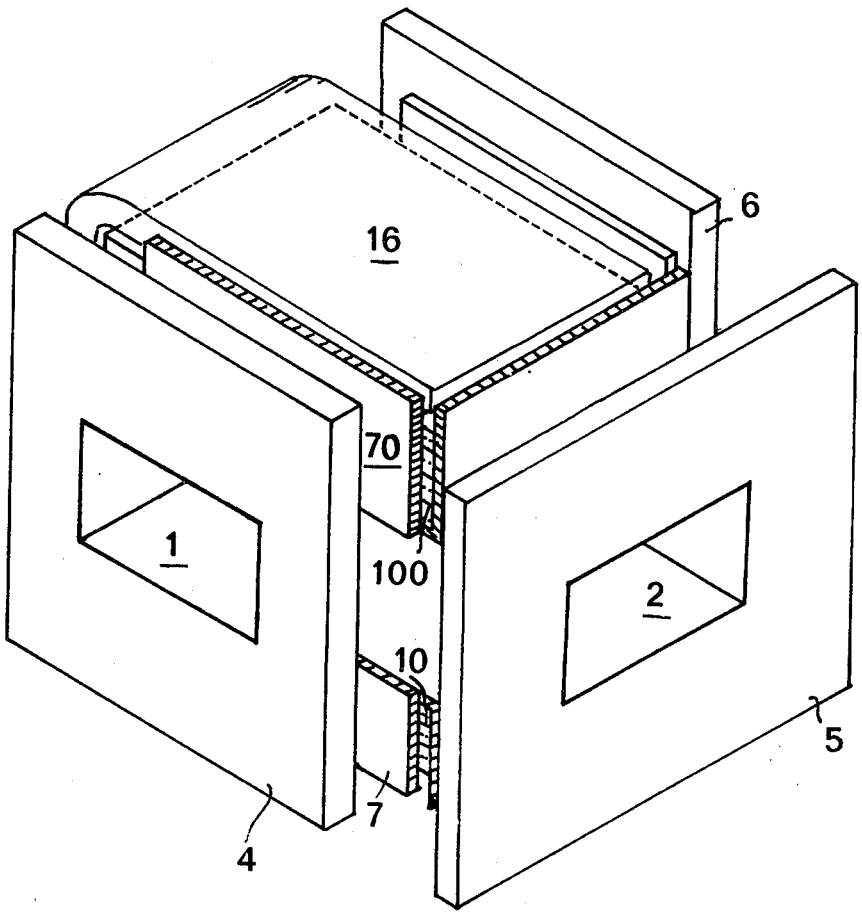
FIG. 1 is a general view of a circulator in accordance with the invention.

FIG. 1 shows a perspective view of a circulator in accordance with the invention. In this view two wave-guide sections 1 and 2, the only ones visible, are terminated by standardized flanges 4 and 5 whereas wave-guide section 3 (not visible) is terminated by flange 6 only a part of which can be seen. Cooling fins appear at 70 and the permanent magnet is chip 100 only a very small fraction of which can be seen between fins 70. A soft iron yoke 16 channels the lines of force of the magnetic field on the outside of the circulator. In the lower part of the circulator are disposed fins 7 respectively homologous to 70 and a second permanent magnet 10 homologous to magnet 100.

Figure 2:
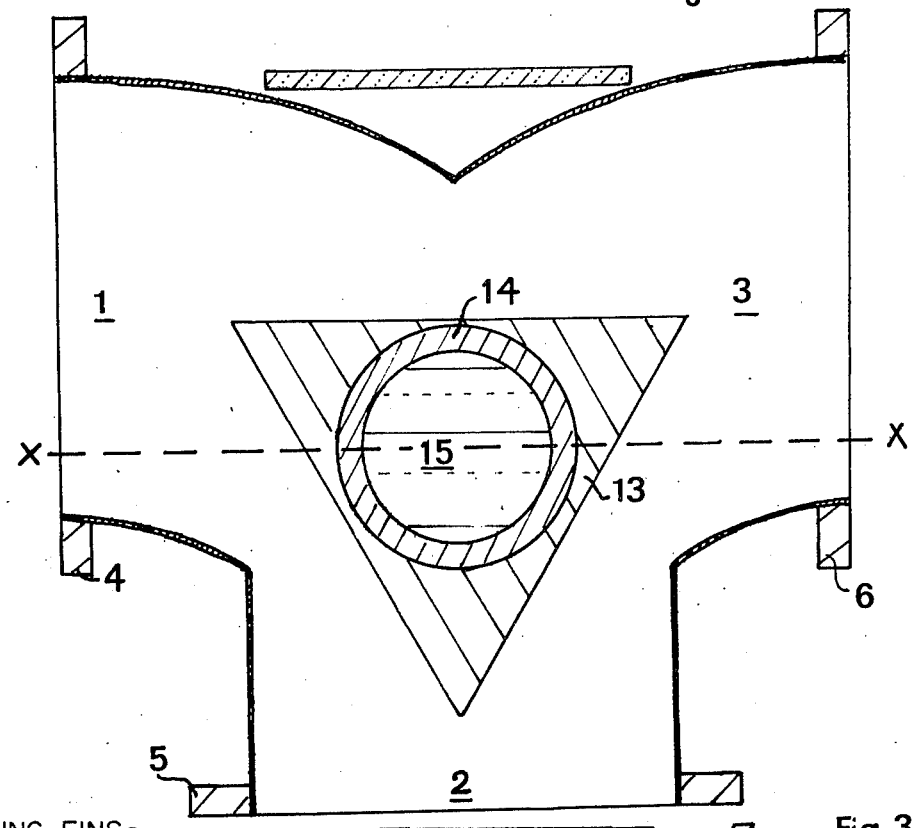
FIG. 2 shows a horizontal section of the circulator of the preceding figure.

FIG. 2 shows a top view of the lower part of the criculator assumed cut along the medium plane common to the three wave-guide sections. The references already used in connection with the preceding figure have been used again without change. Wave-guides 1, 2 and 3 are assembled at 120° to each other. However, sections 1 and 3 are curved so as to present flanges 4 and 6 parallel to each other and perpendicular to flange 5. Matching block 13 which may be either added by brazing to the wall of the cavity formed at the junction of 1, 2 and 3, or cast in one piece with 1, 2 and 3, is pierced and allows to pass therethrough soft iron pole piece 14 on which the gyromagnetic chip 15 is fixed, for example, by brazing. Yoke 16 appears cut on the side opposite the standardized flange 5. Line XX represents the location of the sectional plane of the following figure.

Figure 3:
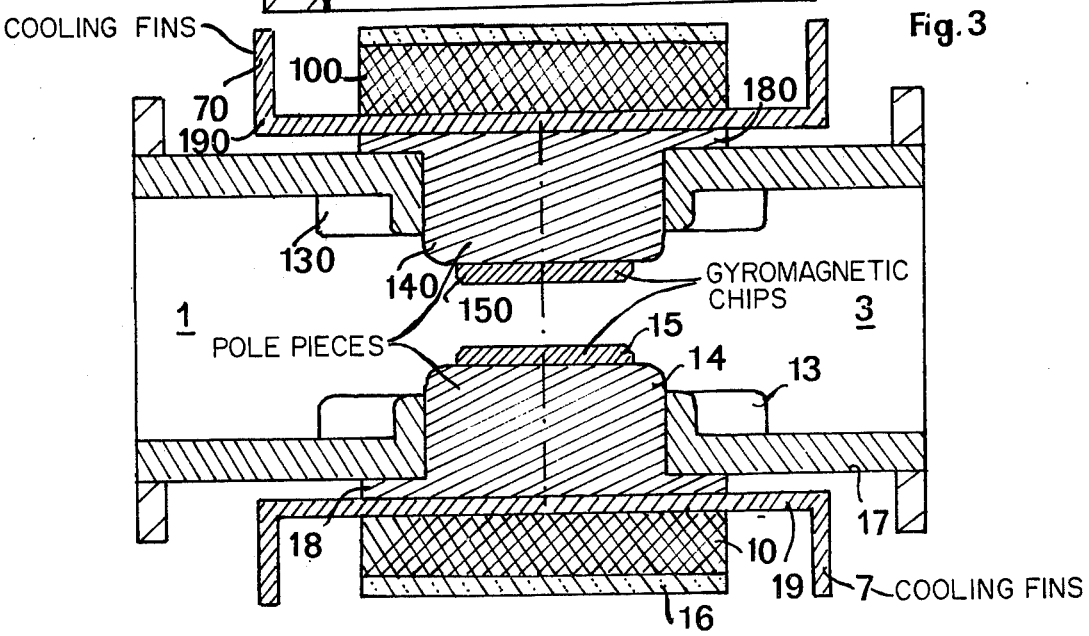
FIG. 3 shows the section of a first embodiment of the circulator along line XX of the preceding figure.

FIG. 3 shows the same embodiment in section. Guides 1 and 3 can be recognized. Matching block 13 is shown on FIG. 3 cast in one piece with wall 17 of the cavity formed by the junction of sections 1, 2 and 3. Pole piece 14 passes through member 13-17. The diameter of the part of the pole pieces penetrating into the cavity of the junction of the wave-guides is greater by at least 20% than the diameter of gyromagnetic chips 15 and 150 so as to place these latter in an homogeneous magnetic field. The distance between pole pieces 14 and 140 is at most equal to 30% of their diameter and has been chosen with respect to the pass-band of the circulator. The wall of the pole pieces is, furthermore, coated with a silver coating for re-establishing the electric continuity with the matching blocks. The extension given to blocks 13 and 130 has been chosen so as to maintain the insertion loss below 0.1 dB. So as to maintain the temperature of chips 15 and 150 at a value close to the ambient temperature in spite of the inevitable losses of which they are the seat, they are associated with plates whose edges are bent so as to form the fins, respectively 7 and 70, cooled by natural convection. The metal plates respectively 19 and 190 are brazed to the shoulders 18 and 180 of the soft iron pole pieces 14 and 140. As can then be seen in the figure, the chips which have a slight chamfer on their face directed towards the center of the guide, have a diameter less than that of the pole piece. Experience has shown that the minimum value of the ratio of the diameters is 1.20 so as to obtain a minimization of losses due to the homogeneousization of the internal field in the chip. The maximum value of this ratio is based on the behaviour of the cavity, the resonant frequency depending on the values of the diameters of the pole pieces and chips, on the thickness of the chips and on the penetration of the pole pieces. Practically, the value of 1.20 must be respected within 30%. Experience has shown that the best results are obtained by using chips whose diameter/-thickness ratio is between 6 and 12. A value close to 10 has given good results in the first example described. As is known, the diameter of blocks 13-130 is chosen with a view to optimizing the matching of the impedance of the cavity with that of the guide so as to reduce the total losses. The determination of the side of the blocks and their thickness is made with a view to obtaining optimum matching at the central frequency of the band in which the circulator is to operate. Permanent magnets 10 and 100 are integral with plates 19-190 of the cooling device. The efficiency of the cooling requires the existence of good thermal contact between chips 15 and 150 and pole pieces 14 and 140. This contact is obtained by depositing a fine copper layer both on the chips and on the end of the pole pieces so as to allow them to be assembled by brazing.

By way of illustration, the applicant has constructed a circulator which will be commercialized under the reference F10575 operating in the band between 4.4 and 5 GHz, having three type UG148/U standardized flanges disposed in a T formation at the end of type R48 guide sections. This circulator comprises two iron garnet and yttrium chips having a diameter equal to 20 millimeters and a thickness equal to 2 millimeters;

the distance between the two chips is equal to 3.2 millimeters;

the soft iron pole pieces have a diameter equal to 28 millimeters;

the distance between the pole pieces is equal to 7.5 millimeters;

the matching blocks have a side equal to 70 millimeters and a thickness equal to 5 millimeters;

the rated power for permanent operation of this circulator is equal to 2 kW;

the insertion loss is at most equal to 0.06 dB in the band;

decoupling is at least equal to 20 dB in the pass-band.

As a second example, the applicant will commercialize under the reference F10500 a circulator operating in the frequency band between 14 and 14.5 GHz and having three type UG419/U standardized flanges disposed in T formation at the end of three type R140 wave-guide sections. This circulator comprises two iron garnet and yttrium chips having a diameter equal to 6 millimeters and a thickness of 0.6 millimeter;

the distance between the two chips is equal to 1.10 millimeter;

the soft iron pole pieces have a diameter equal to 8 millimeters;

the distance between the pole pieces is equal to 3.3 millimeters;

the matching blocks have a side equal to 18 millimeters and a thickness equal to 2.5 millimeters;

the rated power of the wave admitted by this circulator is equal to 200 watts;

the insertion loss in the band is equal to 0.10 dB;

decoupling in the band is at least equal to 25 dB.

Figure 4:
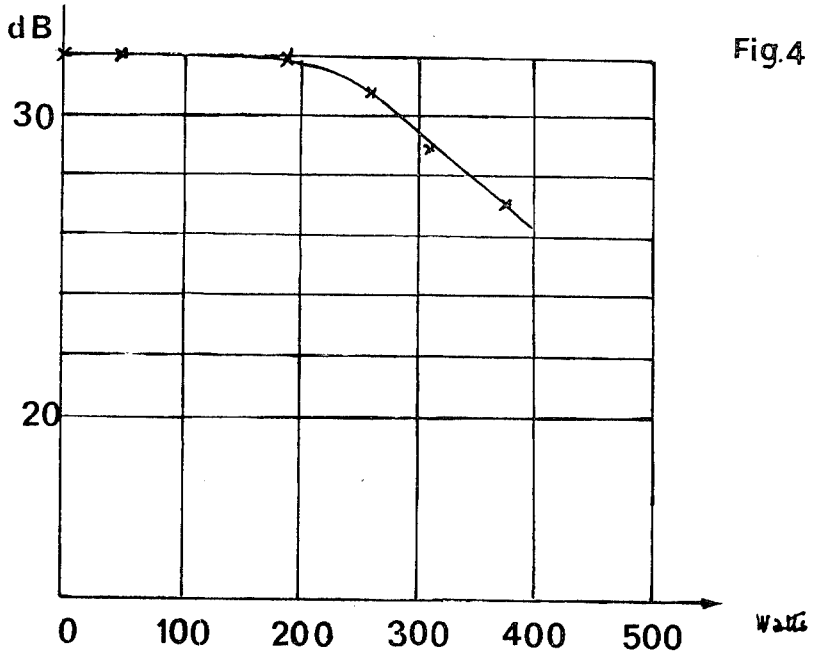
FIG. 4 shows the variation curve of the decoupling of the circulator of the invention with respect to the power of the ultra-high frequency wave.

FIG. 4 shows the variation curve for the decoupling at the central frequency of the pass-band with respect to the power of the incident wave in the circulator. It can be seen that at 400 watts, decoupling is again 26 dB.

Figure 5:
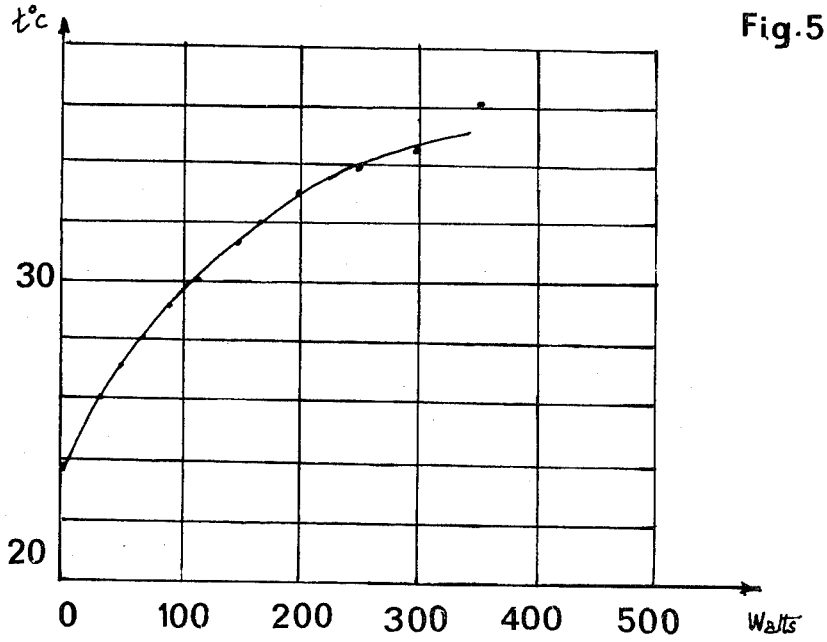
FIG. 5 shows the variation curve of the temperature of the fins with respect to the power of the incident wave.

FIG. 5 shows the temperature measured on the cooling fins with respect to the power of the ultra-high frequency wave fed in at the input of this same circulator. It will be noted that at 300 watts the rise in temperature remains less than 35° C. These two curves are relative to the second example.

Figure 6:
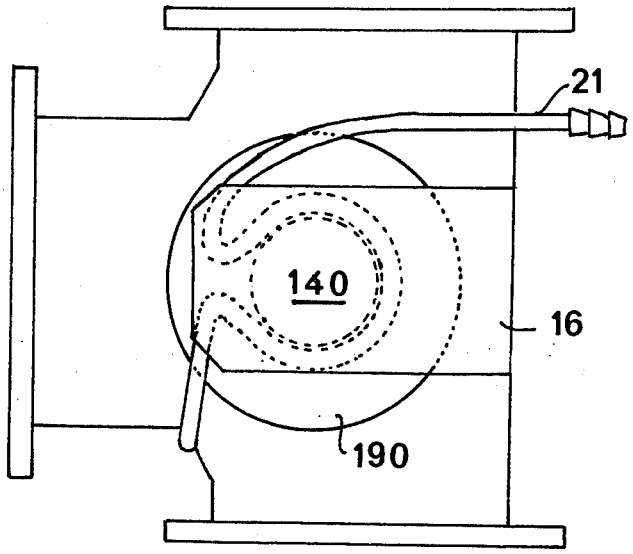
FIG. 6 shows a second embodiment of the circulator of the invention.

FIG. 6 shows another embodiment of the preceding circulator in which the cooling efficiency has been increased by welding a cooper pipe 21 to plates 19 and 190 of FIG. 3. The pipe through which flows a stream of cold water is sufficient to maintain the temperature of plates 19 and 190 constant. This embodiment is particularly useful at low frequencies of the ultra-high frequency band.

By way of illustration, the applicant has constructed a circulator of this type which will be commercialized under the reference F10573 operating in the frequency band between 2.4 and 2.5 GHz, having three UG553/U standardized flanges disposed in T formation at the end of type R26 wave-guide sections. This circulator comprises two iron garnet and yttrium chips having a diameter equal to 50 millimeters and a thickness equal to 3 millimeters;

the distance between the chips is equal to 5.8 millimeters;

the pole pieces have a diameter equal to 60 millimeters;

the distance between the pole pieces is equal to 11.8 millimeters;

the matching blocks have a side equal to 110 millimeters and a thickness equal to 12.5 millimeters;

the power admitted by the circulator is equal to 6 kW in permanent operation. This power may reach 12 kW when a short-circuit is placed at the second gate;

the insertion loss of this circulator is less than 0.06 dB in the pass-band;

decoupling is greater than 25 dB.

Figure 7:
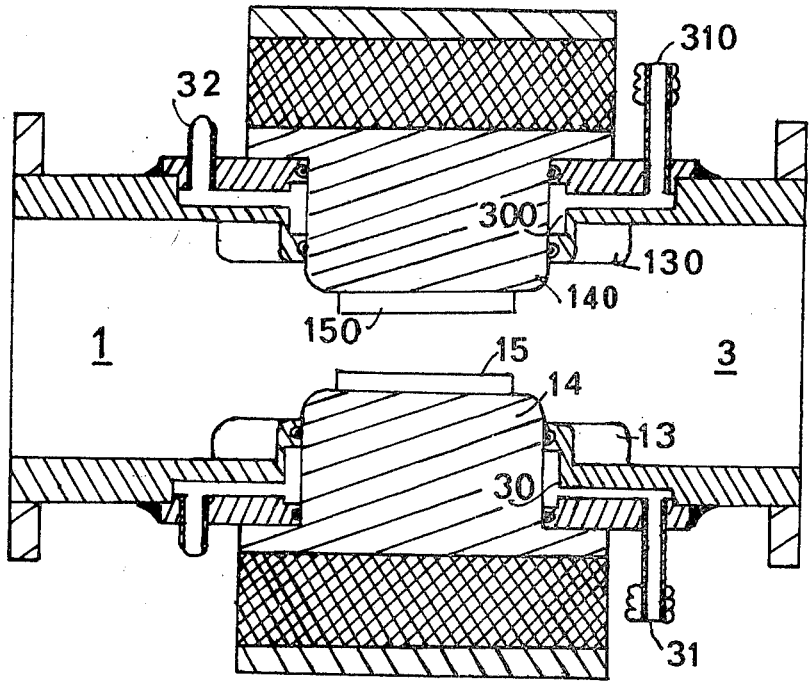
FIG. 7 shows a third embodiment of the circulator of the invention.

FIG. 7 shows another embodiment of the circulator in which the cooling efficiency is increased (1) by putting one wall of the pole pieces directly in contact with the cold water of one flow, (2) by providing the groove 30 in matching blocks 13 and 130 so as to reduce to the maximum degree the path through which the heat flows in the pole pieces. Grooves 30 and 300 are fed, for example, by means of delivery pipe 310. The stream of water which arrives is divided into two streams each describing a semicircumference about pole piece 140 before joining up again in pipe 32 communicating grooves 30 and 300. Similarly, two streams of water describe a semicircumference about pole piece 14 before joining up again in the outlet pipe 31.

It is apparent that within the scope of the invention, modifications and different arrangements can be made other than is here disclosed. The present disclosure is merely illustrative with the invention comprehending all variations thereof.

What is claimed is:

1. A three-gate power circulator on a Y wave-guide whose magnetic biasing circuit comprises soft iron pole pieces passing through the walls of the cavity joining said wave-guides whose ends plunging into said cavity are directly in contact with a gyromagnetic material chip, the improvement consisting in said pole pieces each passing, furthermore, through a metal matching block integral with the wall of the cavity, having a section between that of the gyromagnetic chips and that of said blocks and being in contact with a cooling device, said cooling device being formed by heat-conducting metal members brazed to shoulders of the pole pieces and whose periphery thereof is bent back to form fins which are cooled by natural convection.

2. The power circulator as claimed in claim 1, wherein the cooling device further comprises a pipe welded to said heat-conducting metal members through which a fluid flows.

3. The power circulator as claimed in claim 1, wherein the distance between said pole pieces is at most equal to 30% of their diameter.

4. The power circulator as claimed in claim 1 in which the ratio between the diameter of the pole pieces and that of the gyromagnetic chips is equal to $1.2 \pm 30\%$.

5. The power circulator as claimed in claim 1, wherein the ratio between the diameter and the thickness of the gyromagnetic chips is between 6 and 12.

6. A three-gate power circulator on a Y wave-guide whose magnetic biasing circuit comprises soft iron pole pieces passing through the walls of the cavity joining said wave-guides whose ends plunging into said cavity are directly in contact with a gyromagnetic material chip, the improvement consisting in said pole pieces each passing, furthermore, through a metal matching block integral with the wall of the cavity, having a section between that of the gyromagnetic chips and that of said blocks and being in contact with a cooling device, wherein the cooling device puts one wall of the pole pieces directly in contact with a fluid flow.

* * * * *